US009815281B2

(12) United States Patent
Lin

(10) Patent No.: US 9,815,281 B2
(45) Date of Patent: Nov. 14, 2017

(54) IMAGE FORMING AGENT STORAGE MEMBER AND DIGITAL MACHINE THEREWITH

(71) Applicant: AVISION INC., Hsinchu (TW)

(72) Inventor: Chia-Hsin Lin, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/504,432

(22) Filed: Oct. 2, 2014

(65) Prior Publication Data

US 2016/0023460 A1 Jan. 28, 2016

(30) Foreign Application Priority Data

Jul. 24, 2014 (TW) ..... 103125348 A

(51) Int. Cl.
*B41J 2/14* (2006.01)
*B41J 29/13* (2006.01)
*B41J 2/175* (2006.01)

(52) U.S. Cl.
CPC ..... *B41J 2/14* (2013.01); *B41J 2/175* (2013.01); *B41J 29/13* (2013.01); *B41J 2/17509* (2013.01)

(58) Field of Classification Search
CPC ..... B41J 2/14; B41J 2/17503; B41J 2/17506; B41J 2/17513; B41J 2/17553; B41J 2/17556; B41J 29/13; B41J 2/175; B41J 2/17509
USPC ..... 347/44, 85, 86, 87
See application file for complete search history.

(56) References Cited

U.S. PATENT DOCUMENTS 5,500,663 A * 3/1996 Ujita ..... B41J 2/17596 137/493.1
5,980,029 A * 11/1999 Hayao ..... B41J 2/17506 347/85
6,032,010 A * 2/2000 Kim ..... B41J 2/1755 222/DIG. 1
6,264,316 B1 * 7/2001 Chino ..... B41J 2/175 347/86
6,485,383 B1 * 11/2002 Hendricks ..... B41J 19/20 474/101
6,776,479 B2 * 8/2004 Ardito ..... B41J 2/17506 347/85
9,498,967 B2 * 11/2016 Leenen ..... B41J 2/175
(Continued)

FOREIGN PATENT DOCUMENTS

CN 1087691 C 7/2002
CN 2597202 Y 1/2004
CN 100333915 C 8/2007
(Continued)

*Primary Examiner* — Julian Huffman
*Assistant Examiner* — Michael Konczal

(57) ABSTRACT

An image forming agent storage member capable of being resupplied with an image forming agent is disclosed. The image forming agent storage member includes a housing, an image forming agent entry, and a fluid-discharge mechanism. The housing is for carrying the image forming agent. The image forming agent entry is disposed at one end of the housing. The fluid-discharge mechanism is disposed on a surface of the housing. When the image forming agent is injected into the housing via the image forming agent entry, a fluid inside the housing is discharged via the fluid-discharge mechanism. A digital machine includes the said image forming agent storage member is also disclosed.

18 Claims, 7 Drawing Sheets

(56) References Cited

U.S. PATENT DOCUMENTS

| | | | | |
|---|---|---|---|---|
| 2005/0012794 | A1* | 1/2005 | Chau | B41J 2/17513 347/86 |
| 2007/0046742 | A1 | 3/2007 | Inoue | |

FOREIGN PATENT DOCUMENTS

| | | | |
|---|---|---|---|
| CN | 201580055 | U | 9/2010 |
| CN | 204077072 | U | 1/2015 |
| TW | I259336 | | 8/2006 |
| TW | I302231 | | 10/2008 |
| TW | 201413403 | A | 4/2014 |

* cited by examiner

IMAGE FORMING AGENT STORAGE MEMBER AND DIGITAL MACHINE THEREWITH

BACKGROUND OF THE INVENTION

1. Field of the Invention

The present invention relates to an image forming agent storage member and a digital machine therewith, and more particularly, to an image forming agent storage member capable of being resupplied with an image forming agent and a digital machine therewith.

2. Description of the Prior Art

A multifunction product, such as with print and copy functions, is indispensable equipment to an office. The multifunction product often has a printing module for spreading an image forming agent, such as toner and ink, on a medium, paper for example, for forming a predetermined pattern. The image forming agent is a consumable part and required to be periodically replaced or resupplied. It is a general practice to replace a storage member for carrying the image forming agent, such as a toner cartridge and an ink cartridge. However, it not only takes high cost but also wastes the image forming agent remaining in the storage member because the replaced storage member is not going to be reused. Therefore, it is not beneficial to environmental protection. In recent years, there is another practice to supply image forming agent into the original storage member instead of replacing the storage member. For end users, the image forming agent or the storage member is not limited to a specific brand anymore so that end users are able to purchase a general supplemental package of the image forming agent. Thus, it reduces the cost and improves the convenience.

However, there are some problems in a process of injecting the image forming agent into the conventional storage member. For example, in the case that the conventional storage member has only one opening, the image forming agent is not able to be injected but spreads over an image forming agent entry because the air inside the storage member cannot be discharged. For solving the above-mentioned problem, an auxiliary opening can be further designed for ventilation, but the image forming agent also tends to flow out from the auxiliary opening. The leaked image forming agent might harm a human body if entering the human body via skin or the respiratory tract, and moreover, the leaked image forming agent damages the multifunction product as well.

SUMMARY OF THE INVENTION

The present invention provides an image forming agent storage member capable of being resupplied with an image forming agent, and a digital machine therewith, for solving above drawbacks. The present invention makes it easy to resupply the image forming agent storage member with the image forming agent and to prevent the image forming agent from flowing out of the forming agent storage member. Therefore, the present invention can achieve the effects of environmental protection, convenience, and safety.

According to the claimed invention, an image forming agent storage member includes a housing, an image forming agent entry, and a fluid-discharge mechanism. The housing is for carrying an image forming agent. The image forming agent entry is disposed on an end of the housing. The fluid-discharge mechanism is disposed on a surface of the housing and for discharging a fluid inside the housing when the image forming agent is injected into the housing via the image forming agent entry.

According to the claimed invention, a digital machine capable of being resupplied with image forming agent, includes a casing, an image forming member, a fixing member and the said image forming agent storage member. The image forming member is disposed in the casing for forming an image on a medium. The fixing member is disposed in the casing for fixing the image on the medium. The said image forming agent storage member disposed on a side of the image forming member.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
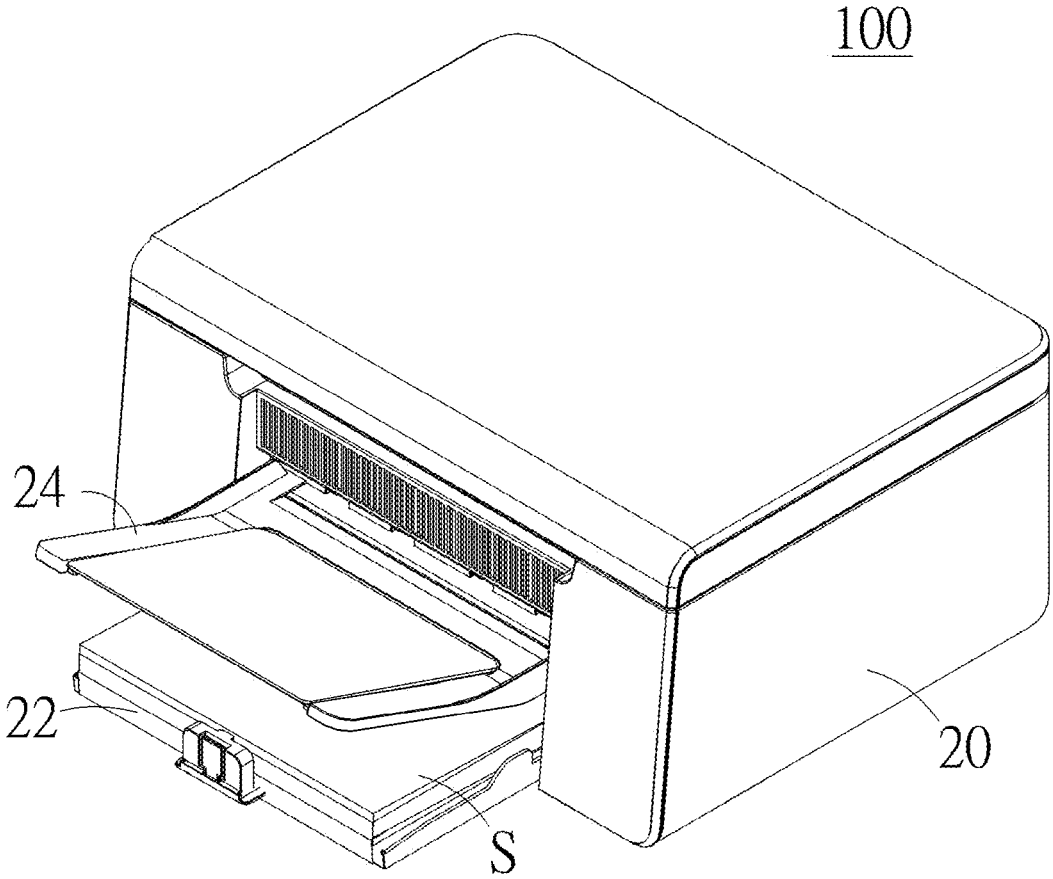
FIG. 1 is a schematic drawing of a digital machine according to a preferred embodiment of the present invention.
Figure 2:
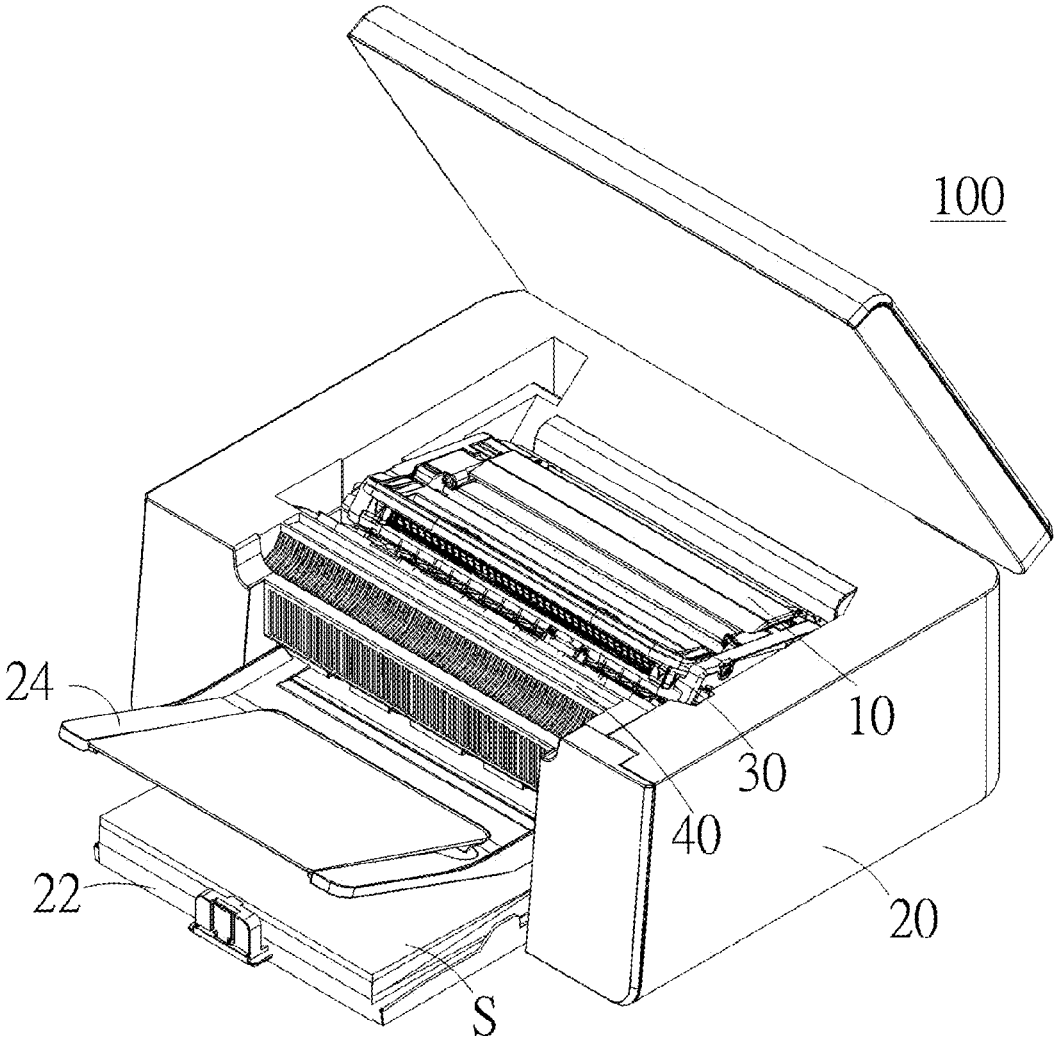
FIG. 2 is an internal diagram of the digital machine according to the preferred embodiment of the present invention.

Please refer to FIG. 1 and FIG. 2. FIG. 1 is a schematic drawing of a digital machine 100 according to a preferred embodiment of the present invention. FIG. 2 is an internal diagram of the digital machine according to the preferred embodiment of the present invention. The digital machine can be a multifunction product with a printing function or a printer. As shown in FIG. 1 and FIG. 2, the digital machine 100 includes a casing 20, an image forming agent storage member 10, an image forming member 30, and a fixing member 40. The image forming member 30 is disposed in the casing 20 for forming a predetermined image on a medium S, such as paper or a transparent plate. The image forming member 30 can be an Organic Photo Conductor Drum (OPC drum) of a laser printer in this embodiment, and it is not limited to this description. For example, the image forming member 30 also can be a printing head of an ink jet printer or another image forming member that is capable of forming an entity image on the medium S. The image forming agent storage member 10 is disposed on a side of the image forming member 30. The fixing member 40 is disposed in the casing 20 for fixing the image formed by the image forming member 30 on the medium S. Take a thermal pressing roller set for example, an image forming agent, such as toners, can be melted on the medium S with high temperature and high pressure. However, the image forming agent of the present invention includes, but not limited to, the above-mentioned mechanism. The digital machine 100 further includes a paper tray 22, the medium S, and an exit tray 24. The medium S goes through a forming process of the image forming member 30 and a fixing process of the fixing member 40 and then is discharged and accumulated on the exit tray 24.

Figure 3:
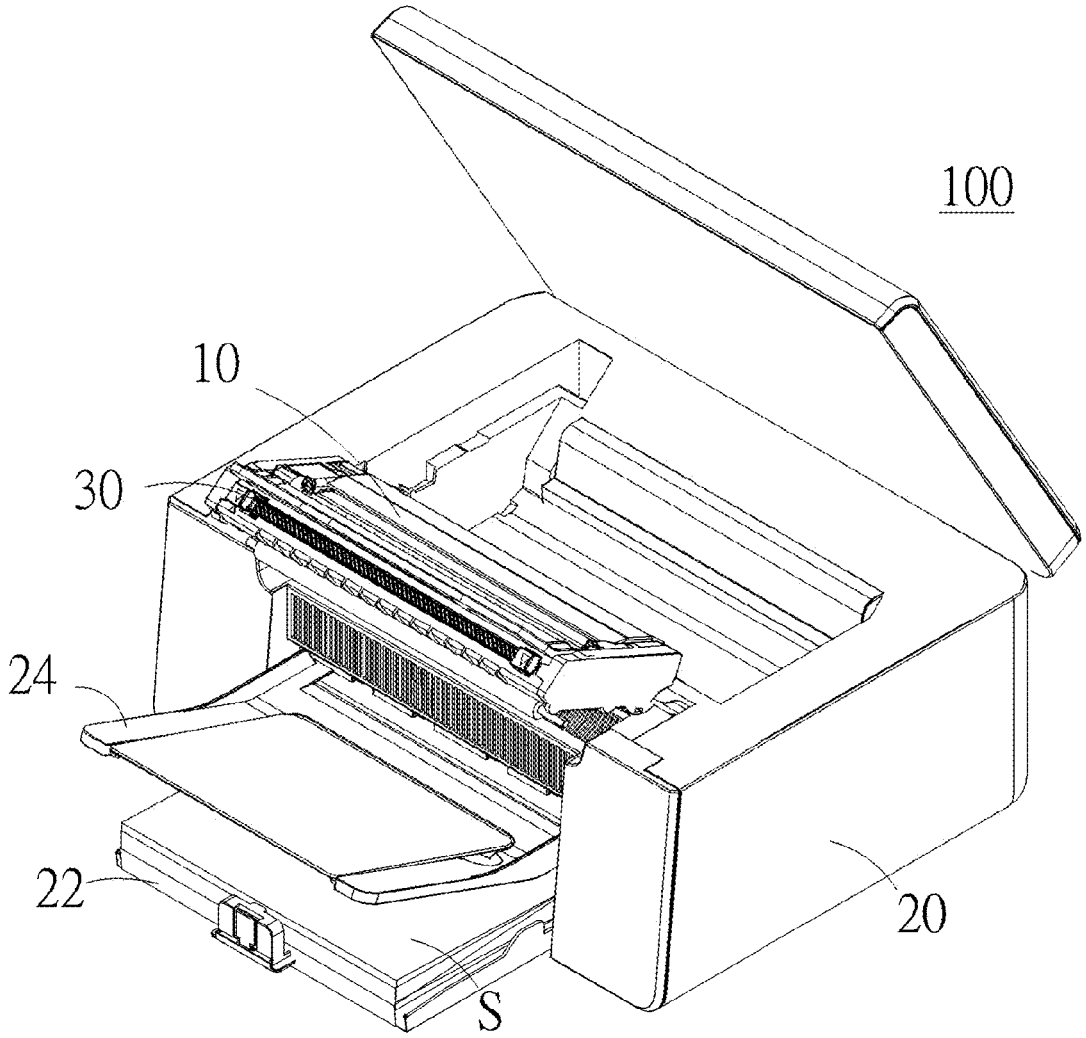
FIG. 3 is a disassembly diagram of an image forming member, an image forming agent storage member, and a casing according to the preferred embodiment of the present invention.
Figure 4:
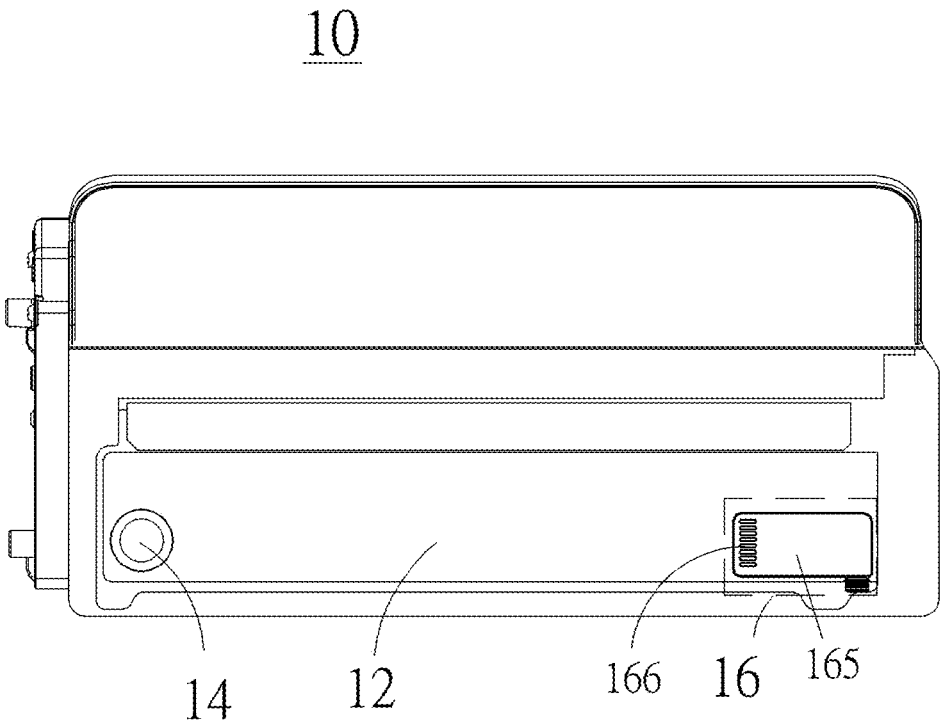
FIG. 4 is a diagram of the image forming agent storage member according to the preferred embodiment of the present invention.

Please refer to FIG. 3. FIG. 3 is a disassembly diagram of the image forming member 30, the image forming agent storage member 10, and the casing 20 according to the preferred embodiment of the present invention. As shown in FIG. 3, the image forming agent storage member 10 can be detached from the casing 20. Please refer to FIG. 4. FIG. 4 is a diagram of the image forming agent storage member 10 according to the preferred embodiment of the present invention. As shown in FIG. 4, the image forming agent storage member 10 includes a housing 12, an image forming agent entry 14, and a fluid-discharge mechanism 16. The housing 12 is for carrying the image forming agent which is not shown in figures. The image forming agent can be toners or ink that is spread over the medium S. The image forming agent entry 14 is disposed on an end of the housing 12. The image forming agent is injected into the housing 12 via the image forming agent entry 14. The image forming agent entry 14 can further include a bolt cover. The bolt cover seals holes of the image forming agent entry 14 in normal times but is to be dismantled so as to resupply the image forming agent.

In contrast to the image forming agent entry 14, the fluid-discharge mechanism 16 is disposed on another end of a top surface of the housing 12 far from the image forming agent entry 14 because of that if the distance between the image forming agent entry 14 and the fluid-discharge mechanism 16 is too short, it is difficult to resupply the image forming agent storage member 10 with the image forming agent. Furthermore, the image forming agent entry 14 and the fluid-discharge mechanism 16 both are disposed on the top surface of the image forming agent storage member 10 so that the image forming agent deposits downwards by gravity rather than flows out of the image forming agent storage member 10 during a process of resupplying the image forming agent. A fluid inside the housing 12 is discharged via the fluid-discharge mechanism 16 when the image forming agent is injected into the housing 12 via the image forming agent entry 14. The fluid may include flowing gas, liquid, or solids that exist inside the housing 12. Besides, the fluid-discharge mechanism 16 further restrains the image forming agent within the fluid from flowing out of the image forming agent storage member 10, and the operational principle is described as follows.

Figure 5:
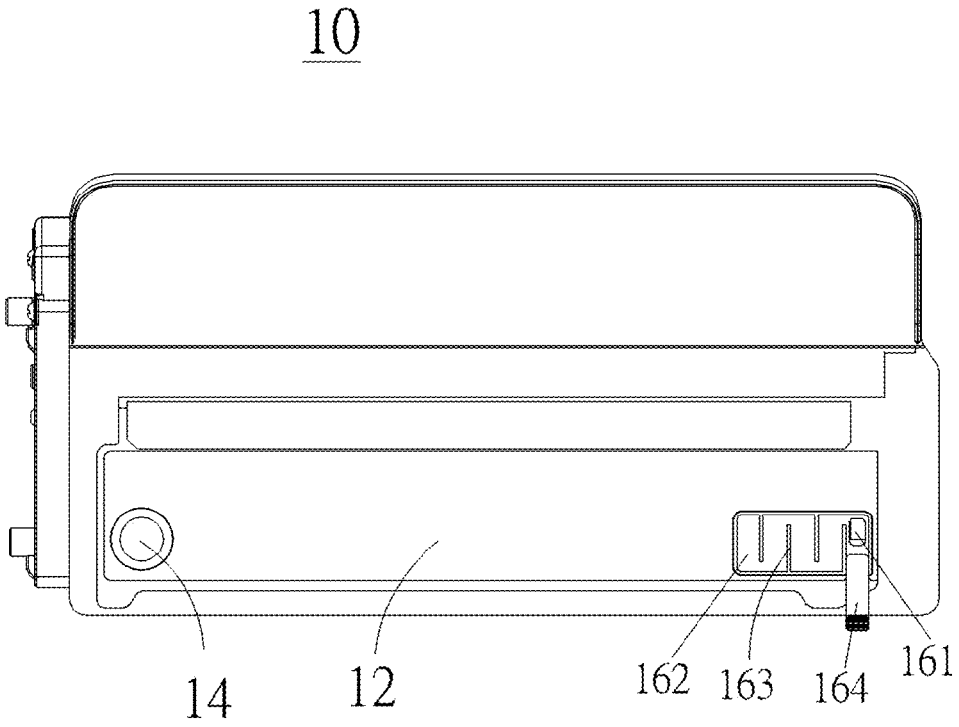
FIG. 5 is a diagram of the image forming agent storage member without showing a top cover according to the preferred embodiment of the present invention.

The fluid-discharge mechanism 16 includes a discharging outlet 161, a discharging channel 162, a blocking member 163, and a top cover 165. An aperture 166 is formed on the top cover 165. Please refer to FIG. 5. FIG. 5 is a diagram of the image forming agent storage member 10 without showing the top cover 165 according to the preferred embodiment of the present invention. The purpose of not showing the top cover 165 is for clearly illustrating the components of the fluid-discharge mechanism 16 under the top cover 165. The top cover 165 still exists under the normal condition. As shown in FIG. 5, the discharging outlet 161 is disposed on the top surface of housing 12, and the fluid inside the housing 12 flows out of the housing 12 via the discharging outlet 161. The discharging channel 162 is disposed on an outer side of the discharging outlet 161 and is provided for the fluid to pass through. The blocking member 163 is disposed in the discharging channel 162 for restraining the image forming agent from flowing out of the image forming agent storage member 10 and making a path of the discharging channel 162 more curved and more extended. In this embodiment, the blocking member 163 is formed as a fence for stopping the image forming agent mixed with the fluid that is discharged from the discharging outlet 161, and forces the image forming agent to accumulate in the discharging channel 162 so as to prevent the image forming agent from spreading out of the image forming agent storage member 10. However, the present invention is not limited to this embodiment. The blocking member 163 also can be a mesh, a sheet, or any mechanism that is capable of stopping the image forming agent from flowing out of the image forming storage member 10.

Figure 6:
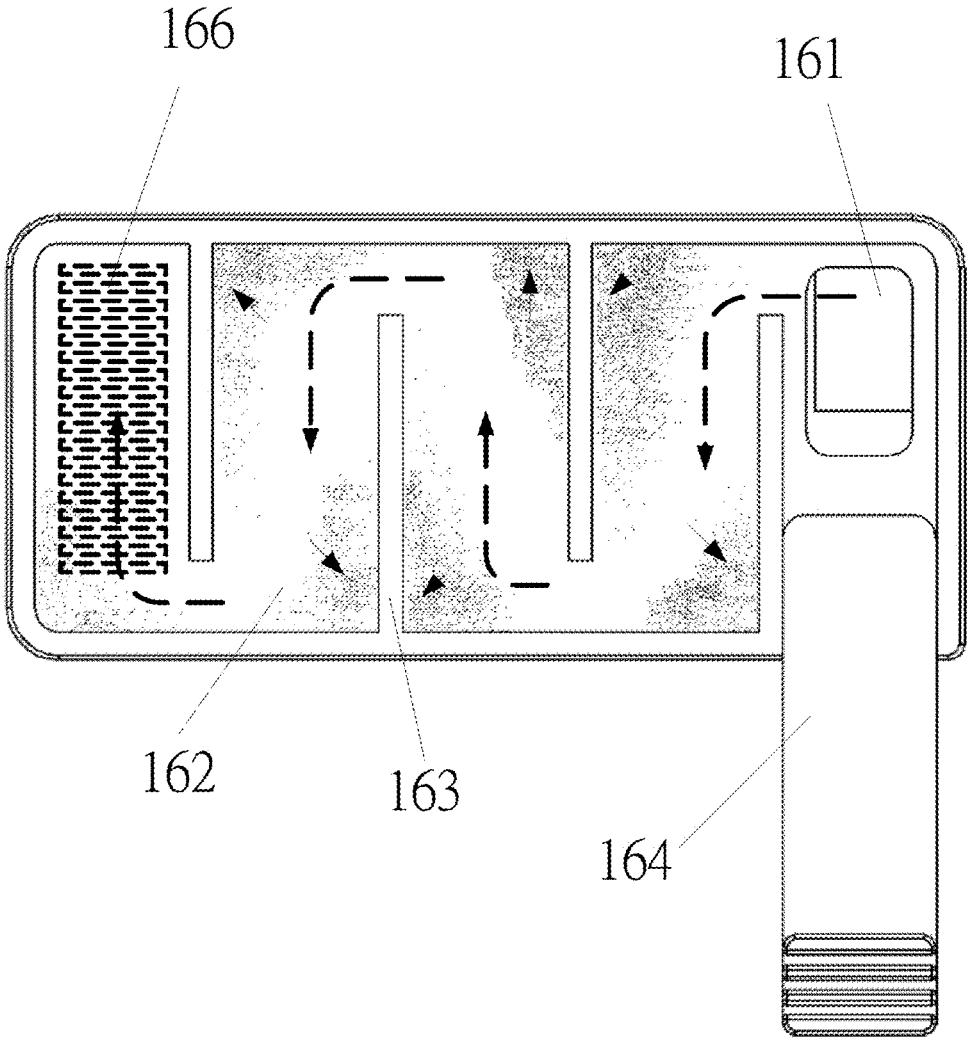
FIG. 6 is a diagram of a fluid-discharge mechanism without showing the top cover according to the preferred embodiment of the present invention.

As shown in FIG. 4 and FIG. 5, the top cover 165 covers the blocking member 163 and the discharging outlet 161, and the discharging channel 162 is formed by the housing 12 and the top cover 165 cooperatively. Furthermore, the discharging outlet 161 is covered by an end of the top cover 165, and the aperture 166 is formed on another end of the top cover 165. Please refer to FIG. 6. FIG. 6 is a diagram of the fluid-discharge mechanism 16 without showing the top cover 165 according to the preferred embodiment of the present invention. The fluid flows along the dashed arrows shown in FIG. 6 from the discharging outlet 161 to the discharging channel 162. The blocking member 163 stops the image forming agent mixed with the fluid as indicated by the solid short arrows. After the fluid flows through the curved discharging channel 162, the fluid finally flows out of the image forming agent storage member 10 from the aperture 166 on the top cover 165 (not shown in the figure). There is less image forming agent that can reach the aperture 166 located at the end of the discharging channel 162, and thus, such operational mechanism can achieve the effects of safety and cleanness as well as that the aperture 166 is not easy to be clogged so that it is not required to be cleaned and replaced often. In this embodiment, the aperture 166 can be a ventilation opening formed on top cover 165. However, the aperture 166 of the present invention is not limited to this embodiment. The aperture 166 can be any narrow opening that is capable of discharging the fluid, such as a strainer disposed on the top cover 165 and a combination of a strainer and a ventilation opening.

In other words, the fluid-discharge mechanism 16 is designed to help the image forming agent to be smoothly injected into the image forming agent storage member 10 via the image forming agent entry 14 by discharging the fluid accommodated inside the image forming agent storage member 10 and further to make the discharged image forming agent mixed with the fluid restrained and accumulated in the fluid-discharge mechanism 16 by disposing the blocking member 163 in the discharging channel 162 so that it is not easy for the image forming agent to spread out of the image forming agent storage member 10 so as to protect the human body and the environment. With such mechanism, it can achieve the excellent effects of that it is convenient to resupply the image forming agent, the light structure, safety, and environmental protection.

On the other hand, no matter when the image forming agent storage member 10 is being resupplied with the image forming agent or in normal operation, the top cover 165 covers both the discharging outlet 161 and the blocking member 163. Users can dismantle the top cover 165 to clean the image forming agent accumulated on the discharging channel 162, if required. In contrast to other designs, the present invention provides a faster way to clean the fluid-discharge mechanism 16 without any consumable part of filtration, such as a strainer. Additionally, the discharging channel 162, which is formed by the top cover 165 and the housing 12 cooperatively, saves the mechanism and reduces the space occupied by the image forming agent storage member 10.

Figure 7:
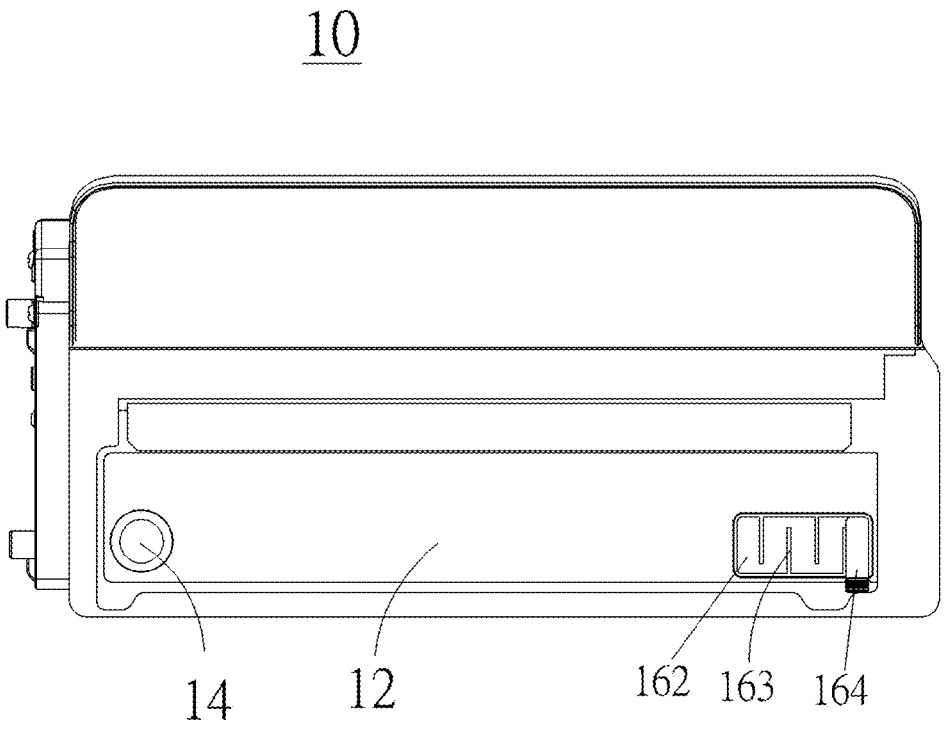
FIG. 7 is a diagram of the image forming agent storage member as a shielding member is in a shielding position according to the preferred embodiment of the present invention.

Furthermore, the fluid-discharge mechanism 16 further includes a shielding member 164 which is for revealing the discharging outlet 161 in a revealing position and for shielding the discharging outlet 161 in a shielding position. Please refer to FIG. 7. FIG. 7 is a diagram of the image forming agent storage member 10 when the shielding member 164 is in the shielding position according to the preferred embodiment of the present invention. The shielding member 164 stops the fluid inside the housing 12 from flowing out via the discharging outlet 161 when the shielding member 164 is in the shielding position. When it is desired to resupply the image forming agent, users just pull out the shielding member 164 to the revealing position for revealing the discharging outlet 161, as shown in FIG. 5, so that the image forming agent can be smoothly injected into the image forming agent storage member 10 via the image forming agent entry 14. After finishing the supplement, users can push back the shielding member 164 to the shielding position for stopping any fluid or the image forming agent from flowing out of the image forming agent storage member 10. The shielding member 164 can be a mechanism capable of being manually adjusted, and the purpose thereof is to prevent an unnecessary loss caused by the image forming agent flowing out of the discharging outlet 161 and to reduce the frequency of cleaning the fluid-discharge mechanism 16 effectively to extend the service life when the image forming agent storage member 10 is not being resupplied with the image forming agent, for example, the image forming agent storage member 10 is in operation.

In summary, the present invention provides the image forming agent storage member capable of being resupplied with the image forming agent, and the digital machine including the said image forming agent storage member. The present invention makes it easy to resupply the image forming agent storage member with the image forming agent and to prevent the image forming agent from flowing out of the forming agent storage member. Therefore, the present invention can achieves effects of environmental protection, convenience, and safety.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image forming agent storage member capable of being resupplied with an image forming agent comprising:
- a housing for carrying the image forming agent;
- an image forming agent entry disposed on an end of the housing; and
- a fluid-discharge mechanism disposed on a surface of the housing and for discharging the image forming agent inside the housing during a period that the image forming agent is injected into the housing via the image forming agent entry, the fluid-discharge mechanism comprising:
  - a discharging outlet disposed on the surface of the housing, and the image forming agent inside the housing flowing out of the housing via the discharging outlet;
  - a shielding member slidably disposed above the discharging outlet for revealing the discharging outlet in a revealing position and further for shielding the discharging outlet in a shielding position;
  - a discharging channel disposed on an outer side of the discharging outlet and provided for fluid to pass through; and
  - a blocking member disposed in the discharging channel for restraining the image forming agent from flowing out of the image forming agent storage member.

2. The image forming agent storage member of claim 1, wherein the fluid-discharge mechanism is disposed on another end of the housing far from the image forming agent entry.

3. The image forming agent storage member of claim 1, wherein the fluid-discharge mechanism restrains the image forming agent from flowing out of the image forming agent storage member.

4. The image forming agent storage member of claim 1, wherein the blocking member extends along a path of the discharging channel.

5. The image forming agent storage member of claim 1, wherein the fluid-discharge mechanism further comprises a top cover, the discharging channel is formed by the housing and the top cover cooperatively, and the top cover covers the blocking member and the discharging outlet.

6. The image forming agent storage member of claim 5, wherein the discharging outlet is covered by an end of the top cover, an aperture is formed on another end of the top cover, and the image forming agent flows through the discharging outlet and the discharging channel and flows out of the image forming agent storage member via the aperture.

7. The image forming agent storage member of claim 5, wherein the top cover is combined with the housing detachably.

8. The image forming agent storage member of claim 1, wherein the shielding member stops the image forming agent inside the housing from flowing out via the discharging outlet when the shielding member is in the shielding position.

9. The image forming agent storage member of claim 1, wherein the discharging outlet is separated from the image forming agent entry, and the shielding member is not slidably disposed above the image forming agent entry.

10. A digital machine capable of being resupplied with an image forming agent, comprising:
- a casing;
- an image forming member disposed in the casing for forming an image on a medium;
- a fixing member disposed in the casing for fixing the image on the medium; and an image forming agent storage member disposed on a side of the image forming member, the image forming agent storage member comprising:

a housing for carrying the image forming agent;

an image forming agent entry disposed on an end of the housing; and a fluid-discharge mechanism disposed on a surface of the housing and for discharging the image forming agent inside the housing during a period that the image forming agent is injected into the housing via the image forming agent entry, the fluid-discharge mechanism comprising:

a discharging outlet disposed on the surface of the housing, and the image forming agent inside the housing flowing out of the housing via the discharging outlet;

a shielding member slidably disposed above the discharging outlet for revealing the discharging outlet in a revealing position and further for shielding the discharging outlet in a shielding position;

a discharging channel disposed on an outer side of the discharging outlet and provided for fluid to pass through; and a blocking member disposed in the discharging channel for restraining the image forming agent from flowing out of the image forming agent storage member.

11. The digital machine of claim 10, wherein the fluid-discharge mechanism is disposed on another end of the housing far from the image forming agent entry.

12. The digital machine of claim 10, wherein the fluid-discharge mechanism restrains the image forming agent from flowing out of the image forming agent storage member.

13. The digital machine of claim 10, wherein the blocking member extends along a path of the discharging channel.

14. The digital machine of claim 10, wherein the fluid-discharge mechanism further comprises a top cover, the discharging channel is formed by the housing and the top cover cooperatively, and the top cover covers the blocking member and the discharging outlet.

15. The digital machine of claim 14, wherein the discharging outlet is covered by an end of the top cover, an aperture is formed on another end of the top cover, and the image forming agent flows through the discharging outlet and the discharging channel and flows out of the image forming agent storage member via the aperture.

16. The digital machine of claim 14, wherein the top cover is combined with the housing detachably.

17. The digital machine of claim 10, wherein the shielding member stops the image forming agent inside the housing from flowing out via the discharging outlet when the shielding member is in the shielding position.

18. The digital machine of claim 10, wherein the discharging outlet is separated from the image forming agent entry, and the shielding member is not slidably disposed above the image forming agent entry.

* * * * *